United States Patent [19]

Schotz

[11] Patent Number: 4,947,180

[45] Date of Patent: Aug. 7, 1990

[54] FM ANTENNA

[75] Inventor: Larry Schotz, Mequon, Wis.

[73] Assignee: Terk Technologies Corporation, New Rochelle, N.Y.

[21] Appl. No.: 365,805

[22] Filed: Jun. 14, 1989

[51] Int. Cl.[5] ..... H01Q 1/38; H01Q 7/00

[52] U.S. Cl. ..... 343/743; 343/744; 455/291

[58] Field of Search ..... 343/741, 743, 744, 748, 343/866, 870; 455/293, 291

[56] References Cited

U.S. PATENT DOCUMENTS

| | | | |
|---|---|---|---|
| 3,582,951 | 6/1971 | Altmayer | 343/743 |
| 4,518,965 | 5/1985 | Hidaka | 343/744 |
| 4,647,937 | 3/1987 | Hidaka et al. | 343/743 |

*Primary Examiner*—Michael C. Wimer

*Attorney, Agent, or Firm*—Bryan, Levitin, Franzino & Rosenberg

[57] ABSTRACT

An antenna assembly which is suited for receiving FM signals, comprises a pair of insulating disc shaped substrates which each have conductive patterns deposited on one surface thereof. The first insulating substrate has an electrically conductive loop element extending around approximately 360° on the first substrate. The loop element terminates at first and second terminals which are adjacent each other. An electrically conductive tap element is deposited on one surface of the second substrate. The tap element extends around approximately 180° and is parallel to half of the length of the loop element. On end of the tap element is electrically connected to a mid-point of the loop element intermediate its first and second terminals. Plate areas are deposited on the substrate and are electrically connected to selected terminals of the loop and tap elements to form capacitors. A first relatively large value capacitor is thus defined between the first and second terminals of the loop element and a second smaller value capacitor is defined between the second terminal of the loop element and opposite end terminal of the tap element. This forms a passive antenna. An active antenna can be formed using discreet components as the capacitors. An amplifier is connected over a signal capacitor to an output of the antenna to form an active antenna assembly.

16 Claims, 2 Drawing Sheets

FIG. 1
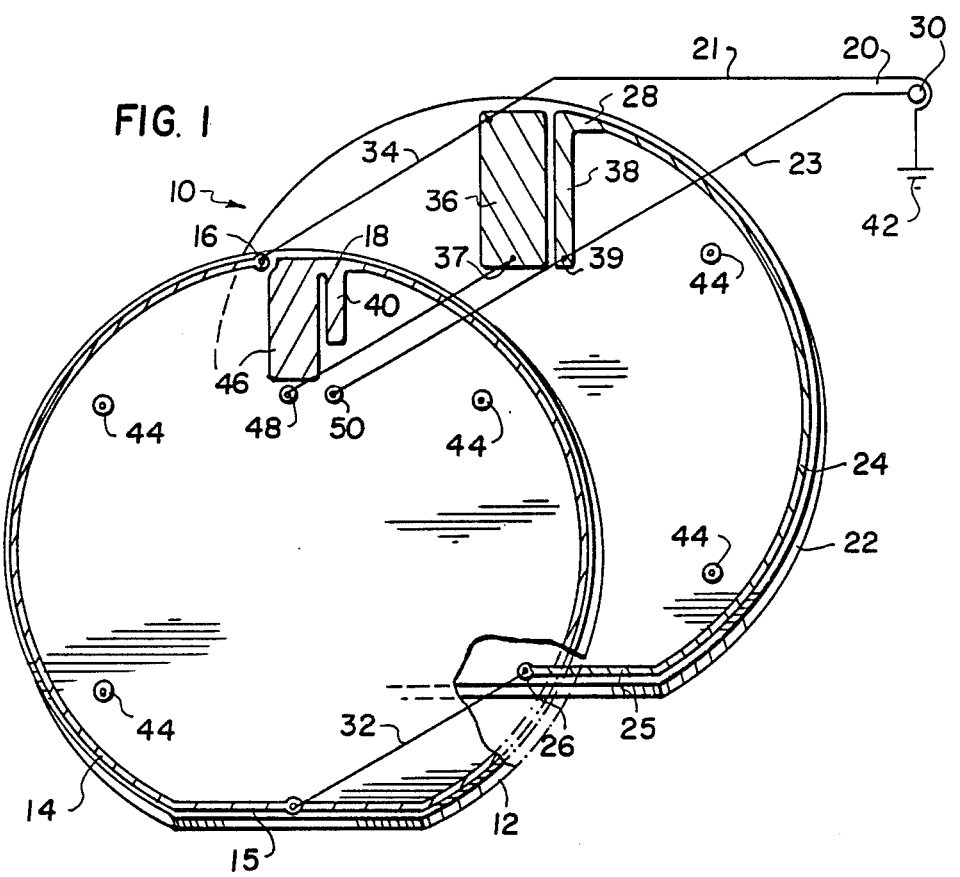
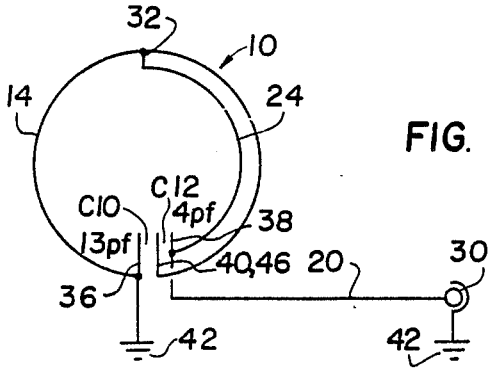
FIG. 2

FM ANTENNA

FIELD AND BACKGROUND OF THE INVENTION

The present invention relates in general to antennas, and in particular to a new and useful antenna for efficiently receiving FM radio transmissions.

A U.S. patent application entitled ANTENNA, Ser. No. 07/107,007, filed Oct. 13, 1987, now U.S. Pat. No. 4,801,944, discloses an antenna which comprises a loop element that extends around approximately 360° and terminates in first and second terminals, with a tap element electrically connected near the mid-point of the loop element, and extending around approximately one half of the loop element. The tap element has an output terminal which is positioned near a third terminal of the antenna, and near the first and second terminals of the loop element. A first capacitor is connected between the first and second terminals of the loop element, a second capacitor is connected between the second terminal of the loop element and the output terminal of the tap element, and a third capacitor is connected between the output terminal of the tap element and the third terminal. The three capacitors are selected to have values which improve the signal receiving capacity of the antenna, particularly for radio signals in the FM frequency range of about 88 to 108 MHz.

While this antenna includes several important insights and has advantages over previously existing antennas, additional refinements are necessary to produce a practical and efficient, technologically and commercially viable product.

SUMMARY OF THE INVENTION

The present invention comprises refinements in an antenna having a loop plus tap structure, which includes both passive and active embodiments.

An object of the present invention is to provide an antenna which is sensitive to an appropriate band of desired radio frequencies, while being less sensitive to unwanted radio frequencies.

A further object of the present invention is to provide an antenna which operates passively and is constructed in the simplest possible manner while still maintaining its high sensitivity to desired radio frequencies and low sensitivity to unwanted radio frequencies.

A further object of the invention is to provide an active antenna which boosts the desired signals received by the antenna and further enhances the antenna's capacity to distinguish between desired and undesired radio frequencies.

A still further object of the invention is to provide an antenna which may be of the active or passive type and which has directional characteristics when used in a vertical orientation, and omnidirectional characteristics when used in a horizontal orientation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 1 is an exploded view of a passive FM antenna constructed in accordance with the present invention;

FIG. 2 is a schematic representation of the antenna shown in FIG. 1.

DESCRIPTION OF THE PREFERRED EMBODIMENTS

Figure 3:
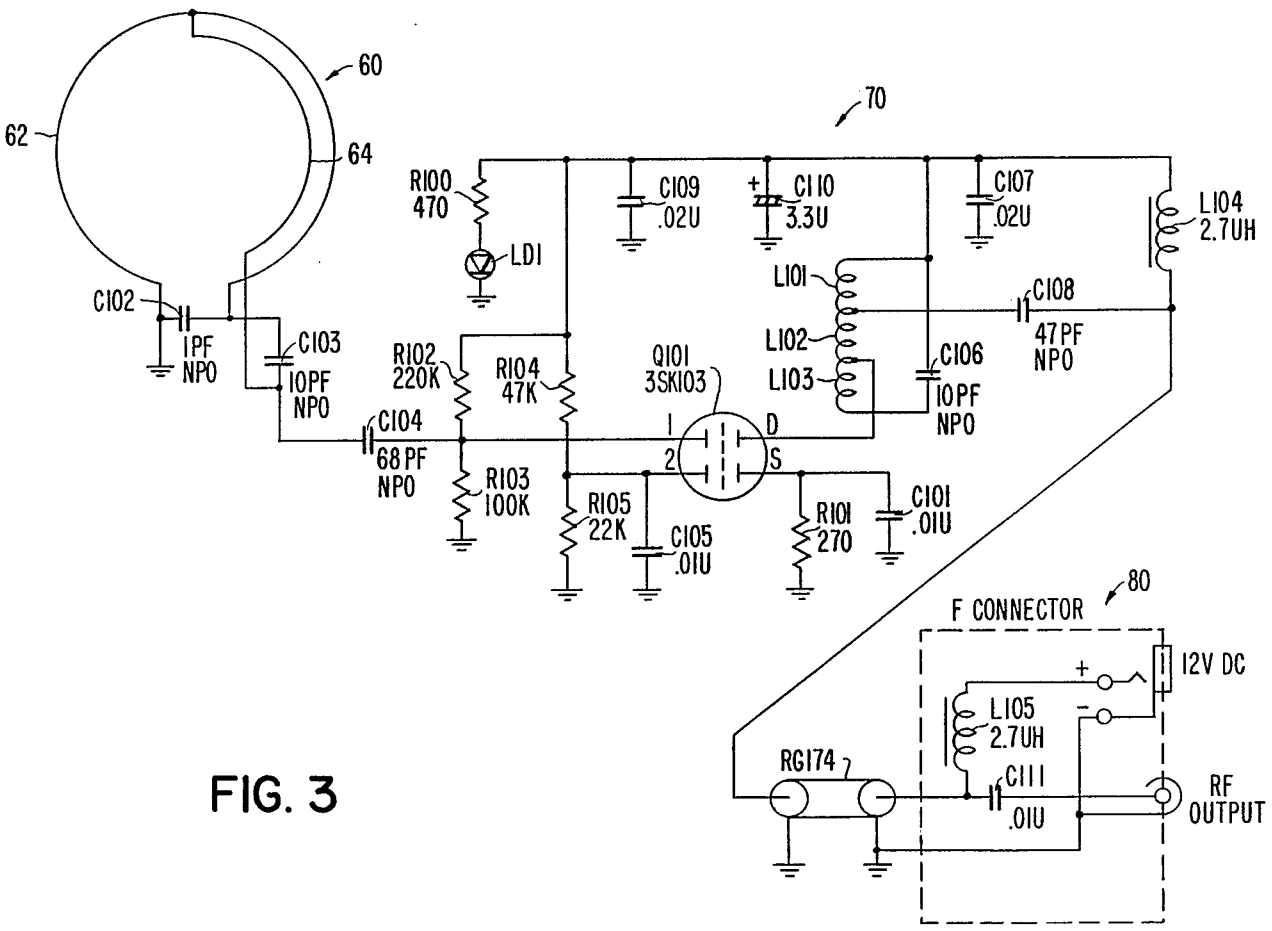
FIG. 3 is a schematic representation of an active FM antenna constructed in accordance with the present invention.

Referring to the drawings in particular, the invention embodied in FIGS. 1 and 2 comprises a passive antenna generally designated 10 which is particularly sensitive to radio signals in the FM frequency range.

The antenna 10 comprises a first insulating substrate 12 which carries an electrically conductive loop element 14 on one side thereof. Substrate 12 is advantageously in the form of a disc made of glass epoxy material which is conventionally used for circuit board applications. Loop element 14 may be in the form of copper plating having a thickness, for example, of 0.0014 inches, plated directly onto one surface of the substrate 12. The disc forming substrate 12, and the loop element 14, advantageously have a diameter of approximately 4.45 inches. By selecting this dimention for the loop element 14, the loop element has a length of approximately 14 inches. This length is less than 1/6 of the wave length of radio waves at 100 MHz, corresponding to a little above mid range for the FM frequency spectrum of 88 to 108 MHz. The wave length of this near mid range frequency is approximately 120 inches.

Antenna 10 also includes a second substrate or disc 22 which is constructed of the same material as substrate 12. Substrate 22 carries an electrically conductive tap element 24 which extends around approximately 180° of the substrate 22. As with loop element 14, tap element 24 may be constructed by copper plating on the surface of substrate 22.

FIG. 1 shows substrate 12 and 22 spaced from each other. In actual practice, the substrates are connected directly to each other so that tap element 24 extends parallel to and around approximately one half of loop element 14.

Solder coated copper posts 44 are provided on both surfaces of both substrates 12 and 22. These posts can be soldered together to mechanically hold the substrates to each other.

Loop element 14 has first and second terminals 16 and 18 respectively, which are adjacent to but electrically isolated from each other. Tap element 24 has a third terminal 26 which is electrically connected by a schematically shown connection 32, to the mid-point of loop element 14. Connection 32 can be established by a solder or wire connection which extends from the loop element 14 on one side of substrate 12, through the thickness of substrate 12 and to the third terminal 26 on the substrate 22.

In likewise fashion, first terminal 16 of loop element 14 is electrically connected by a connection 34 to a first large capacitor plate 36 which is plated onto the surface of substrate 22.

The second terminal 18 of loop element 14 is enlarged to form a second large capacitor plate 46 which, with substrates 12 and 22 superimposed on each other, faces plate 36 and forms a first capacitor therewith. Capacitor plates 36 and 46 are insulated from each by substrate 12 which is positioned therebetween. .

Tap element 24 has a fourth terminal 28 which is enlarged to form a first small capacitor plate 38 on the surface of substrate 22. Second terminal 18 of loop element 14 is also enlarged to form a second small capacitor plate 40 which is electrically connected to but spaced by a slot from capacitor plate 46. First and second small capacitor plates 38 and 40 are positioned to face each other with the substrates connected to form a second capacitor between the first and fourth terminals.

All capacitor plates are inexpensively made with the same copper plating as the loop and tap element, and are plated onto one surface of the respective substrate.

The relative areas of plates 36, 38, 40 and 46, can be selected to establish the desired capacitance between the terminals of the loop element and between the second terminal of the loop element and the fourth terminal of the tap element. The capacitances are selected to tune the antenna to the desired frequency being received. In actual practice, the first capacitor shown C10 in FIG. 2 advantageously has a value of 13 pf, and is connected between the first and second terminals 16, 18 of the loop element 14. First terminal 16 is also connected to ground 42.

The second capacitor C12 formed by small capacitor plates 38 and 40, advantageously has a value of 4 pf. The fourth terminal 28 of tap element 24 is connected to the center wire of a coaxial cable 20. Coaxial cable 20 having center and shielding wires, is connected to a jack connector 30 of conventional design. Shielding wire 21 is connected to ground 42. Jack 30 provides a connection to an FM receiver or other equipment for receiving radio signals.

To further facilitate the fabrication of the antenna shown in FIGS. 1 and 2, first large capacitor plate 36 can be substantially as long as first small capacitor plate 38, with the two capacitor plates being separated by a slot. The area of capacitor plate 36 is larger than that of capacitor plate 38 due to the increased width of plate 36.

While the connection of cable 20 is schematically illustrated in FIG. 1, other locations can be provided for connecting this cable. A connecting post 48 may be soldered to the lower area 37 of plate 36, through the thickness of substrate 12. This forms a convenient connecting point for the coaxial wire 21 of cable 20. A second connecting post 50 which is also provided on the top surface of substrate 12, can also be soldered to a lower area 39 of plate 38, through the thickness of substrate 12. The central wire 23 of cable 20 can be soldered to connecting post 50. In this way the connecting posts 48 and 50 can be positioned near each other on one surface of the antenna, to form a convenient site for connecting the coaxial cable 20.

Another advantageous characteristic antenna of 10 is the presence of straight area 15 in loop element 14 and superimposed straight area 25 in tap element 24. These can advantageously be positioned adjacent straight edges of the substrates 12 and 22 which form a bottom or base for the antenna 10. A pedestal can be provided at this base area so that the antenna can be oriented in an upright vertical position. In this orientation the antenna takes on a directional characteristic and can be rotated into a position for best reception of a directional signal.

The antenna can also be used in a horizontal position where the 360° extent of loop element 14 provides omnidirectional reception.

The passive antenna of FIGS. 1 and 2 is extremely simple and economical to manufacture while still maintaining high efficiency and sensitivity for receiving radio signals, in particular FM radio signals.

FIG. 3 illustrates an active embodiment of the invention.

In FIG. 3, an antenna 60 constructed in accordance with the present invention is connected to an amplifier 70 which receives power from, and transmits an amplified radio signal to a connector generally designated 80.

Antenna 60 includes loop element 62 and tap element 64 which are connected to each other much the same as loop and tap elements in the embodiment of FIG. 1. While antenna 60 may include integral capacitors as with the antenna 10 in FIG. 1, alternative discrete first and second capacitor components C102 and C103 can be connected to the terminals of the loop and tap elements to complete the antenna 60. The loop element 62 has a diameter of about 4.45 inches.

Tests conducted on the passive antenna 10 shown in FIG. 1, and the antenna 60 with its amplifying circuit 70 and connector 80, demonstrated a response that was substantially uniform over the frequency band of 88 to 108 MHz. Center tuning for both the active and passive embodiments of the invention is typically 100 MHz. This is intentionally set higher than the centerband tuning of about 89 MHz, to serve for balancing the low-band to high-band sensitivity, so that the the two are equal.

Variations in tuning occur with different cable positions.

In order to compensate for characteristics of a specific radio tuner to which the antenna is connected, whether it is of the passive or active type, an adjustable capacitor can be connected between the first and second terminals of the loop element, which can be adjusted by the user of the antenna, using for example a screw driver, to tune the antenna to match the radio receiver.

One technique for the user to tune the antenna is for the user to find a weak station near the center of the frequency band, tune the capacitor which is acting as a trimmer, for the least signal strength, remembering to adjust the trimmer very slowly as it is a fine adjustment, and, after finding the point of least signal strength, rotating the trimmer one quarter turn in one direction.

Returning once more to FIG. 3, second capacitor C103 is connected between the fourth terminal of the tap element 64, and the second terminal of the loop element 62, the first terminal being connected to ground. Capacitor C102 is connected between the first and second terminals of the loop element 62.

Capacitor C103 is also connected to an output of the antenna 60 which in turn is connected over a signal capacitor C104 to the amplifier 70.

Amplifier 70 comprises a dual gate MOSFET Q101 which has a first gate 1 connected to capacitor C104, and a second gate 2 connected to a tuning circuit which draws power from the central conductor of coaxial cable RG174, through a coil L104.

The drain D of MOSFET Q101, is connected to one tap of a coil L101-L103, which amplifies a signal corresponding to the signal on capacitor C104, and supplies the amplified signal to the central conductor of the coaxial cable.

Connector 80 is of a conventional type and includes a 12 V DC jack for applying DC voltage to the coaxial cable, and an RF output jack for use in connecting the amplified antenna signal to a radio receiver.

A light emitting diode LD1 is also connected to power through the central conductor of the coaxial cable, and is illuminated when the amplifier is connected to a source of 12 volts DC.

The resistors, coils and capacitors used in the circuit preferable have the values indicated in FIG. 3. These values have been found to produce the best results in tuning and amplifying the antenna signal.

Capacitor C102 between the terminals of the loop element 62 should have the value of 1 pf and capacitor C103 between the second terminal of the loop element and the output terminals of the tap element, should have the value of 10 pf. Contrary to the preferred values disclosed in the above-identified patent, the values used here are more appropriate to tune the antenna to a representative frequency within the FM frequency band.

Examples of the components used on the circuits of FIG. 3 are as follows:

TABLE

| MODEL | QTY. | MANUFACTURER | DESCRIPTION | REF. IN FIG. 3 |
|---|---|---|---|---|
| 3SK103 | 1 | HITACHI | DUAL GATE MOSFET | Q101 |
| P-376 | 1 | PANASONIC | GREEN LED | LD101 |
| 2.7UH | 2 | | CONFORMAL COATED RF CHOKE | L104 105 |
| | 3 | | 2.75 TURN SPRING COILS | L101 102 103 |
| 9221 | 1 | BELDEN | 67.5 INCH COAX | |
| TE1008 | 1 | | PCB | |
| | 1 | | 11VDC 50MA PLUG IN TRANS | |
| RES | | | 25 WATT 5% CARBON FILM RESISTORS | |
| | 1 | 470 | | R100 |
| | 1 | 270 | | R101 |
| | 1 | 220K | | R102 |
| | 1 | 100K | | R103 |
| | 1 | 47K | | R104 |
| | 1 | 22K | | R105 |
| CAP | | | CERAMIC DISC CAPACITOR | |
| | 1 | | 1PF NPO | C102 |
| | 2 | | 10PF NPO | C103 106 |
| | 1 | | 47Pf NPO | C108 |
| | 1 | | 68PF NPO | C104 |
| | 3 | | .01UF Z5U 25V | C101 105 111 |
| | 2 | | .02UF Z5U 25V | C107 109 |
| CAPT | 1 | | 3.3UF 25V TANTALUM CAPACITOR | C110 |

While a specific embodiment of the invention has been shown and described in detail to illustrate the application of the principles of the invention, it will be understood that the invention may be embodied otherwise without departing from such principles.

What is claimed is:

1. An antenna comprising:

an electrically insulating substrate;

an electrically conductive loop element on one side of said substrate, said loop element having first and second terminals which are adjacent each other;

an electrically conductive tap element on an opposite side of said substrate, said tap element extending substantially parallel to said loop element and having a length equal to approximately one half of the length of said loop element, said tap element having a third terminal which is diametrically opposite said first and second terminals of said loop element, said third terminal being electrically connected to said loop element, said tap element having a fourth terminal which is adjacent said second terminal of said loop element;

a first large capacitor plate connected to said first terminal;

a second large capacitor plate connected to said second terminal and electrically insulated from said first large capacitor plate, said first and second capacitor plates facing each other and forming a first capacitor connected between said first and second terminals;

a first small capacitor plate connected to said fourth terminal; and a second small capacitor plate connected to said second terminal and electrically insulated from said first small capacitor plate, said first and second small capacitor plates facing each other and forming a second capacitor connected between said second and fourth terminals.

2. An antenna according to claim 1, wherein said loop element, said second large capacitor plate and said second small capacitor plate are fixed to the one side of said substrate, a further electrically insulating substrate connected to said first mentioned insulating substrate, said further substrate having one side facing said opposite side of said first mentioned substrate, said tap element, said first large capacitor and said first small capacitor plate being fixed to said one side of said further substrate.

3. An antenna according to claim 2, wherein said first terminal of said loop element is connected to said first large capacitor plate, through the thickness of said first mentioned substrate.

4. An antenna according to claim 3, wherein said third terminal of said tap element is connected to said loop element through the thickness of said first mentioned substrate.

5. An antenna according to claim 4, wherein said first large and first small capacitor plates are parallel to each other and separated from each other by a slot.

6. An antenna according to claim 5, wherein said second large and second small capacitor plates extend parallel to each other and are at least partly separated by a slot.

7. An antenna according to claim 5, wherein said capacitor plates and said elements are all plated onto one of said substrates.

8. An antenna according to claim 1, wherein said first large and first small capacitor plates are parallel to each other and separated from each other by a slot.

9. An antenna according to claim 1, wherein said second large and second small capacitor plates extend parallel to each other and are at least partly separated by a slot.

10. An antenna according to claim 2, wherein said first mentioned and further insulating substrates have a straight edge near said third terminal of said tap element, said loop and tap elements both having straight portions near said third terminal of said tap element.

11. An antenna assembly comprising:

an electrically insulating substrate;

an electrically conductive loop element on one side of said substrate, said loop element having first and second terminals which are adjacent each other;

an electrically conductive tap element on an opposite side of said substrate, said tap element extending substantially parallel to said loop element and having a length equal to approximately one half the length of said loop element, said tap element having a third terminal which is diametrically opposite said first and second terminals of said loop element, said third terminal being electrically connected to said loop element, said tap element having a fourth terminal which is adjacent said second terminal of said loop element;

a first capacitor connected between said first and second terminals;

a second capacitor connected between said second and fourth terminals;

a signal capacitor having one end connected to said fourth terminal, said signal capacitor having an opposite end;

amplifier means connected to said opposite end of said signal capacitor for amplifying a signal on said signal capacitor originating from said loop and tap elements, said amplifier means including a single output terminal for transmitting an amplified signal and for receiving power for said amplifier means;

connector means for supplying a signal to a radio receiver and for receiving power; and a cable having first and second conductors connected between said amplifier means and said connector means, said first conductor being connected to said single output terminal for supplying power to said amplifier means and for supplying a signal from said amplifier means to said connector means, said second conductor and said first terminal of said loop element being connected to ground.

12. An antenna assembly according to claim 11 wherein said cable comprises a coaxial cable having a central conductor forming said first conductor and a coaxial conductor forming said second conductor.

13. An antenna assembly according to claim 11 wherein said first capacitor has a value of 1 pf and said second capacitor has a value of 10 pf.

14. An antenna assembly according to claim 11, wherein said amplifier means comprises a dual gate MOSFET having first and second gates, a drain and a source, one of said drain and source being connected to said single output terminal of said amplifier means, and the other said source and drain being connected to ground, one of said first and second gates being connected to said opposite end of said signal capacitor.

15. An antenna assembly according to claim 14, wherein said cable comprises a coaxial cable having a central conductor forming said first conductor and a coaxial conductor forming said second conductor.

16. An antenna assembly according to claim 15, wherein said first capacitor has a value of 1 pf and said second capacitor has a value of 10 pf.

* * * * *